United States Patent [19]

Cornelius

[11] Patent Number: 4,635,601

[45] Date of Patent: Jan. 13, 1987

[54] METHOD OF AND ARRANGEMENT FOR REGULATING THE IDLING ROTATIONAL SPEED OF AN INTERNAL COMBUSTION ENGINE

[75] Inventor: Peter Cornelius, Stuttgart, Fed. Rep. of Germany

[73] Assignee: Robert Bosch GmbH, Stuttgart, Fed. Rep. of Germany

[21] Appl. No.: 783,758

[22] Filed: Oct. 3, 1985

[30] Foreign Application Priority Data

Oct. 11, 1984 [DE] Fed. Rep. of Germany ..... 3437324

[51] Int. Cl.[4] ..... F02D 41/16; F02M 3/07

[52] U.S. Cl. ..... 123/339; 123/436

[58] Field of Search ..... 123/339, 419, 436, 585

[56] References Cited

U.S. PATENT DOCUMENTS

| | | | |
|---|---|---|---|
| 4,345,559 | 8/1982 | Kuttner et al. | 123/436 X |
| 4,380,979 | 4/1983 | Takase | 123/339 |
| 4,513,711 | 4/1985 | Braun et al. | 123/339 |

FOREIGN PATENT DOCUMENTS

| | | | |
|---|---|---|---|
| 3224042 | 12/1983 | Fed. Rep. of Germany | 123/339 |
| 146025 | 11/1981 | Japan | 123/339 |
| 160057 | 9/1984 | Japan | 123/339 |

*Primary Examiner*—Tony M. Argenbright
*Attorney, Agent, or Firm*—Michael J. Striker

[57] ABSTRACT

An arrangement for regulating the idling rotational speed of an internal combustion engine includes a comparison stage which compares the actual and the desired rotational speed, an idling operation filling regulation device connected to the output of the comparison stage, including at least a proportional region, and controlling an electrically manipulated adjustment member for the adjustment of the amount of intake air in the idling operation position of the throttling damper, as well as an arrangement for the recognition of a jerky operation of the engine. The recognition arrangement is so constructed that it concludes from the frequency and intensity of periodically occurring rotational speed oscillations that a tendency to operate in a jerky manner is present and issues a signal which so influences the amplification degree of the proportional region of the regulating device for the idling operation regulation that a manipulated variable from the proportional region is maintained during the increasing rotational speed and asymetrically substantially at the maximum achieved value or preferably is caused to gradually decrease with a selectable time constant, while being caused to decrease more rapidly after the detection of the decay of the jerky operation oscillations.

6 Claims, 4 Drawing Figures

METHOD OF AND ARRANGEMENT FOR REGULATING THE IDLING ROTATIONAL SPEED OF AN INTERNAL COMBUSTION ENGINE

BACKGROUND OF THE INVENTION

The present invention relates to a method of regulating the idling rotational speed of an internal combustion engine and to an arrangement for performing such method.

There are already known, for instance, from the U.S. Pat. No. 4,444,471 and from U.S. Pat. No. 4,513,711, systems for the regulation of the idling rotational speed of internal combustion engines, which are also known as so called idling operation filling regulation devices or arrangements. The known systems for the idling operation filling regulation usually comprise, independently or whether are implemented in analog technology utilizing discrete swiching components or switching blocks, or are implemented in a digitized manner and with digital processing utilizing microprocessors, microcomputers and similar digitally operating devices, a regulation region which compares the actual rotational speed or number of revolutions per minute with a predetermined nominal or desired rotational speed and, in dependence on the regulation deviation or error signal, provides a manipulated variable which acts on an idling operation adjustment device which is constructed in a certain way, for instance, as a two-winding rotational adjuster. Herein, the regulation region can be constructed, solely or in combination, to exhibit a proportional, integral and/or differential behavior. The overall idling operation filling regulating arrangement may additionally also include an internal control loop in which, for instance for the adaptation of the adjustment member characteristic behavior, the desired intake air amount is additionally compared with the actual intake air amount or the actual and desired values of the intake pipe pressure are compared with one another. In the final effect, the idling operation adjustment member acts on the available flow-through cross-sectional area in the intake pipe of the respective internal combustion engine, especially by a corresponding increase or decrease of a bypass cross-sectional area or by a mechanical adjustment of the position of a throttling valve or damper.

In the U.S. Pat. No. 4,513,711, there is already addressed the problem, which is encountered in internal combustion engines equipped with idling operation regulation, of tendency toward jerky operation at the idling speeds. This problem results from the fact that, at certain proportions of the fuel/air mixture supplied to the internal combustion engine and/or during certain driving conditions, there come into being rotational speed oscillations or swings which can also be characterized as idling operation sawteeth and which, besides causing an unpleasant jerky operation or motion of the vehicle, can under certain circumstances become so pronounced or enhanced that the internal combustion engine stalls. Especially motor vehicles with manual transmissions which are equipped with an idling operation filling regulation arrangement can have a tendency to operate in a jerky manner, and especially when the respective idling rotational speed regulating device preferably exhibits a proportional-intgral-differential behavior or response, but also when this device exhibits at least a proportional behavior, and when a short-lived gasoline pulse occurs with the transmission in gear and coupled to the engine, for instance.

Another possibility of a jerky operation or motion in the idling operation region of the internal combustion engine can also result when the idling operation filling regulation device is not being used merely for the maintenance of a predetermined idling rotational speed of the engine in idle, but rather is used, for instance, when driving in a convoy or in the so-called stop-and-go traffic, for powering the vehicle. This possibility readily presents itself to the driver under certain circumstances, inasmuch as the idling operation filling regulation device attempts in each instance, to prevent stalling of the engine and to maintain the engine at or close to a predetermined, relatively low, idling operation rotational speed. During such use of the internal combustion engine under load conditions, but at the idling rotational speed, the regulation or control characteristic and behavior is naturally drastically changed, inasmuch as the idling operation filling regulation is so-to-say misused as compared with its intended use for which it has been designed. While it would be possible in this connection to take into account the possibility of switching the regulating or control parameters of the idling operation filling device in dependence on and in response to this operational condition to other, coordinated and appropriate, values, such a possibility is prohibitive, since an information about the coupling of the engine with the transmission train of the vehicle is either not available at all, or can be obtained only in a laborious way.

On the other hand, if one falls back, as a way out of this predicament, on the use of relatively slow regulation or control parameters for the idling operation filling regulation, then the overall regulation behavior becomes problematical, inasmuch as the idling operation filling regulation is provided, in accordance with its very nature, for the purpose of detecting and counteracting possibly occurring interventions into or changes in the rotational speed as quickly as possible and feasible. Thus, exactly in particularly quickly responding regulating devices operative in the area of idling operation filling regulation, the danger of occurrence of pronounced jerky oscillations is particularly apparent, possibly also since the mixture is too lean and operation skips or interruptions occur.

SUMMARY OF THE INVENTION

Accordingly, it is a general object of the present invention to avoid the disadvantages of the prior art.

More particularly, it is an object of the present invention to provide an arrangement of the type here under consideration which does not possess the disadvantages of the known arrangements of this type.

Yet another object of the present invention is to develop an arrangement for use in conjunction with an internal combustion engine equipped with an idling operation filling regulation device, which arrangement is so constructed as to detect and counteract jerky operation oscillations in the rotational speed of the engine, which securely prevents the enhancement of such oscillations and relatively quickly smoothes the operation of the engine.

It is still another object of the present invention to so design the arrangement of the above type as to be able to perform the anti-jerk function thereof, and yet not to detrimentally influence the operation of the idling operation filling regulation device in the absence of the jerky operation detection.

A concomitant object of the present invention is so to construct the arrangement of the above type as to be relatively simple in construction, inexpensive to manufacture, easy to install and use, and reliable in operation nevertheless.

An additional object of the present invention is to devise a method of recognizing and counteracting the tendency of an internal combustion engine to operate in a jerky fashion when in its idling mode of operation.

In pursuance of these objects and others which will become apparent hereafter, one feature of the present invention resides in a method of regulating the idling operational speed of an internal combustion engine using a regulating device having at least a proportional regulation region and operative for controlling the position of an adjustment element which controls the amount of intake air supplied to the engine during the idling operation of the latter, this method including the steps of comparing the actual and the desired rotational speeds of the engine and issuing an error signal indicative of the comparison result to the regulating device; detecting a jerky operation of the engine by evaluating the frequency and the amplitude of rotational speed oscillations; and maintaining a manipulated variable of the proportional regulation region of the regulating device, in response to the detection of the jerky operation, asymmetrically only after an increase in the actual rotational speed, substantially at the respective highest achieved value thereof.

According to another facet of the present invention, there is provided an arrangement for regulating the idling rotational speed of an internal combustion engine using a regulating device having at least a proportional regulation region and operative for controlling the position of an adjustment element which controls the amount of intake air supplied to the engine during the idling operation thereof, this arrangement comprising means for comparing the actual value and the desired value of the rotational speed of the engine and issuing an error signal indicative of the comparison result; means for supplying the error signal to the regulating device; means for detecting a jerky operation of the engine, including means for evaluating the frequency and amplitude of rotational speed oscillations; and means responsive to the detection of the jerky operation by the detecting means for so influencing the amplification degree of the proportional regulation region of the regulating device that at least a manipulated variable that determines the position of the adjustment element is maintained substantially at its maximum achieved value.

The present invention as described so far has the advantage that a possibly encountered jerky operation tendency can be effectively counteracted by damping at the very outset, but that the operation of the regulating device is influenced by the anti-jerk arrangement only in such a manner that it is unnoticeable by the driver of the motor vehicle. Herein, the capability of the regulating device of quickly detect and counteract rotational speed oscillation is maintained and the overall function of the idling operation filling regulation arrangement is assured even in the aforementioned region of its use for powering the vehicle and is smoothed in this region. This is particularly advantageous since this possibility which presents itself for using the idling operation filling regulation for certain operating conditions even for powering the vehicle cannot be prevented in any event.

The incipient jerky operation tendency can be counteracted by the invention in a particularly effective and rapid manner inasmuch as the invention decidedly smoothes or quiets the oscillatory behavior at the adjustment element. The intervention into the operation or displacement of the adjustment element is herein effectuated in such a manner as if (in a simulated manner) the lowest idling rotational speed were constantly encountered. Herein, the effect of the anti-jerk control provided by the present invention is twofold, in that as a result of a sort of peak value rectification (in the proportional region), the varying portion is considerably reduced, and simultaneously, the asymmetry of the intervention of the anti-jerk control arrangement acts in the sense of increasing the rotational speed.

In this manner, any otherwise existing interception problems are avoided and, in addition, there is obtained a stabilizing effect, in that the idling operation rotational speed is lifted up from the jerky operation range.

According to another concept of the present invention, the inventive method further includes the step of causing the manipulated variable to gradually decrease with a selectable time constant, and the intervention into the amplification degree of the proportional regulation region of the regulating device is reminiscent of a peak value rectifier function. To achieve this, the arrangement of the present invention comprises time-delay means, and means for connecting the time-delay means with one of the detecting means and the proportional regulation region of the regulating device in such a manner that the manipulated variable is caused to gradually decrease with a selectable time constant after reaching the maximum achieved value thereof.

It is particularly advantageous when, in accordance with the present invention, the method further comprises the step of causing the manipulated variable to diminish after the decay of the rotational speed oscillations at a relatively high speed until it has reached its original characteristic behavior which it would have had in the absence of the detection of the jerky operation. Thus, the apparatus of the present invention correspondingly includes means for causing the manipulated variable to diminish after the decay of the rotational speed oscillations at a relatively high speed until it has reached its original characteristic behavior which it would have had in the absence of the detection of the jerky operation by the detecting means. This control of the operation of the anti-jerk control arrangement provides for a smooth transition and merger after the termination of the anti-jerk control action.

The novel features which are considered as characteristic of the invention are set forth in particular in the appended claims. The improved idle operation regulating arrangement itself, however, both as to its construction and its mode of operation, together with additional features and advantages thereof, will be best understood upon perusal od the following detailed description of certain specific embodiments with reference to the accompanying drawing.

DETAILED DESCRIPTION OF THE PREFERRED EMBODIMENTS

The present invention is based on the recognition of the fact that the rotational speed oscillations which occur in the idling filling regulation during the jerky motion of the motor vehicle and thus of the internal combustion engine cause corresponding variations of the manipulated variable $P_S$ via the proportional regulation region (proportional negative coupling element) which is present in all idling filling regulation arrangements. These variations or movements of the manipulated variable $P_S$, moreover, can obtain such a disadvantageous phase position with respect to the behavior of the rotational speed in a critical rotational speed and loading region (for instance, while operating the vehicle in the first or second gear) that the negative feedback effect on the manipulated variable movement becomes a positive feedback coupling so that, as a direct result thereof, there is encountered even an enhancement of the jerky oscillations of the rotational speed.

It is a basic concept of the present invention to influence, separate or, in any event, so considerably to reduce the thus formed feedback coupling effect in such a manner that the effect of the proportional manipulated variable with respect to the jerky oscillations in the rotational speed or the enhancement of such oscillations is eliminated, while the regulation arrangement itself is not deleteriously influenced, or is influenced only to a negligible extent, as far as its own function is concerned.

Figure 1:
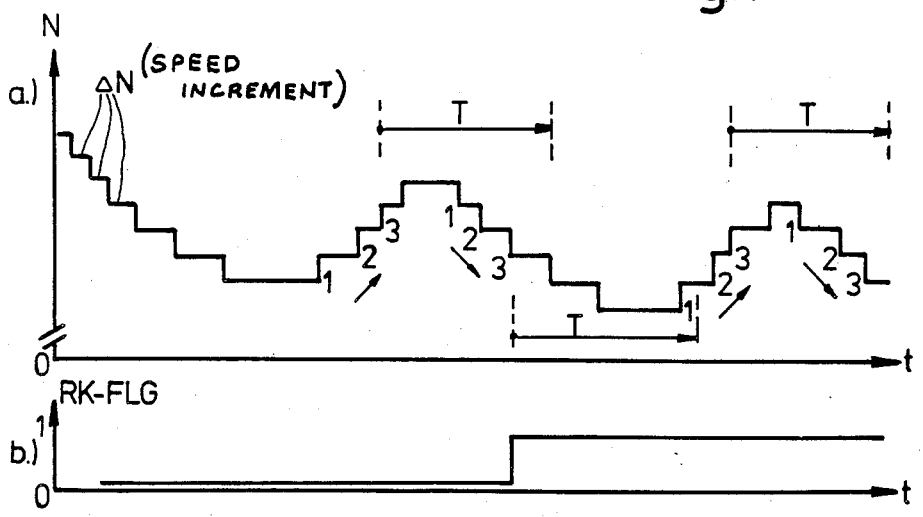
FIG. 1 is a graphic representation of a digitized rotational speed behavior as a function of time and, correlated thereto, a jerky operation recognition signal also as a function of time.

Referring now to the drawing in detail, and first to FIG. 1 thereof, it may be seen that it depicts a digitized behavior of the rotational speed N as a function of time, wherein the individual steps are respectively representative of a rotational speed increment. The aforementioned jerky motion appears as a periodical speed of rotation oscillation with a period of repetition in the range of approximately f=1.5 Hz to 4 Hz, wherein the intensity of the jerky motion is reflected in the amplitude of the rotational speed oscillations. Thus, the jerking motion behavior as depicted in FIG. 1 is rather significant. In order to be able to quickly damp or suppress such jerky motion or behavior, such periodical oscillations must be capable of being detected already when their amplitude is relatively small.

Figure 3:
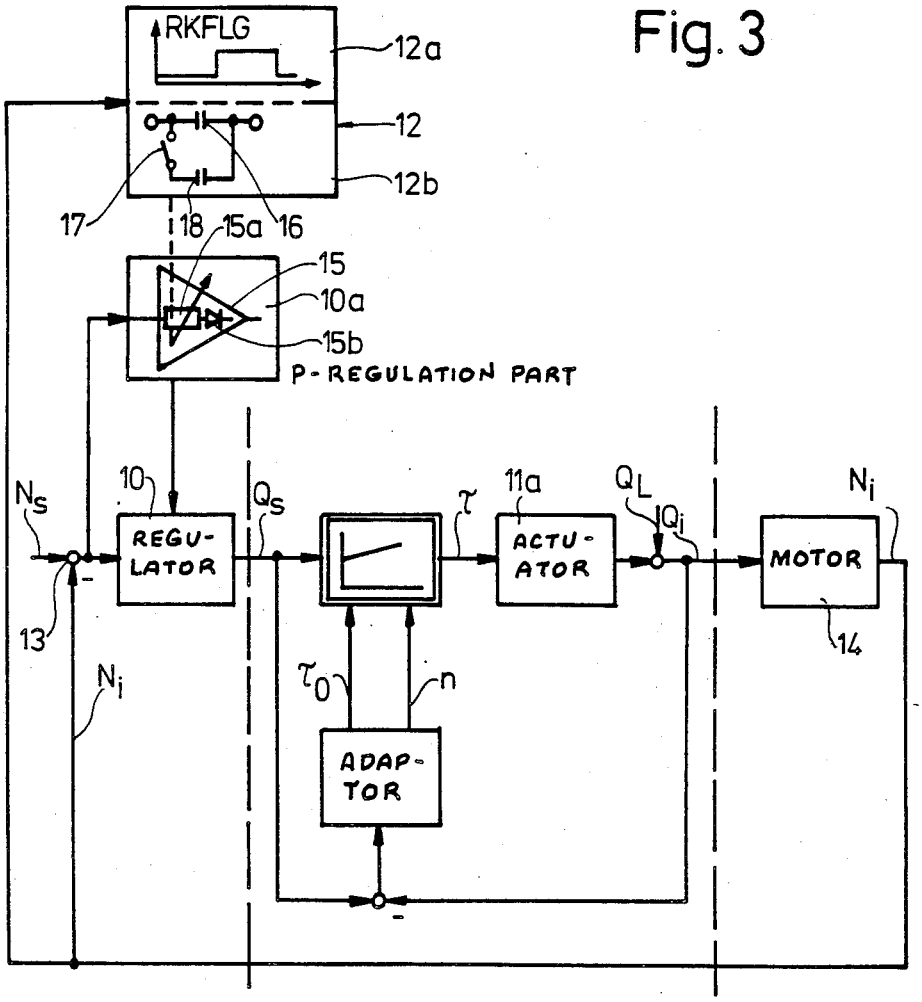
FIG. 3 is a partially diagrammatic block diagram of a possible construction of an anti-jerk control arrangement of the present invention in the environment of its intended use.

Consequently, the present invention utilizes a jerky motion detection circuit which is identified in FIG. 3 of the drawing by the reference numeral 12. Herein, it is to be pointed out in this connection first that the block diagram of the invention which is presented in the drawing and which illustrates the invention on the basis of discrete components or circuit elements does not and is not intended to limit the invention to this particular block diagram or the construction depicted therein. Rather, this block diagram is to particularly serve for indicating the functional basic operations of the invention and special function behaviors in an implementation form which, in any event, is one of many possible. It is to be understood that the individual components or elements and blocks can be constructed in an analog, in a digital, or even in a hybrid form or, in the alternative, corresponding regions of program-controlled digital systems, for instance, of microprocessors, microcomputers and/or digital or analog logic circuits, which regions are fully or partially combined or integrated, can constitute the same. The description of the currently preferred embodiment of the present invention which follows is thus to be evaluated as far as the functional overall and time behavior, the operational behavior achieved by the respective active and/or adressed blocks, and the respective cooperation of such structural components and the partial functions performed by such components or blocks, while the reference to the individual structural components of blocks are only intended to facilitate the understanding of the present invention, and not to limit the latter to the illustrated construction.

For a better understanding of the present invention, the basic concept of a possible idling filling regulation arrangement will be briefly described first with reference to the circuit arrangement example shown in FIG. 3. A comparison location or component at which comparison is made between the desired and the actual rotational speed of the internal combustion engine is identified by the reference numeral 13. The regulating deviation or error signal is supplied to an idling filling regulating device 10 having a proportional region **10*a* which is illustrated as a separate component or block, even though in reality it is incorporated in the device 10, inasmuch as this proportional region 10*a* is to be particularly considered and described in connection with the present invention and its implementation. The output signal of the regulating device 10 is representative of the desired amount $Q_S$ of air which is needed or to be supplied to an internal combustion engine 14, in order to maintain the desired rotational speed. Usually, an additional, also closed, loop for adjustment member characteristic behavior curve adaptation is provided between the internal combustion engine 14 and the idling speed filling regulation device 10; however, this additional loop need not be discussed in any detail in connection with the description of the present invention. In any event, an idling speed adjustment member 11*a* is provided, which determines the flow-through cross-sectional area in the intake pipe of the internal combustion engine 14** and, in this way, the amount Q of air for the idling regulation which is usually conducted through a bypass cross-section.

Now, if the engine rotational speed N increases during a predetermined minimum number i (for instance, i=3) of ignitions and then decreases again during a predetermined time period T, again during a minimum amount i (for instance, i=3) of ignitions, as shown in the characteristic behavior depiction of FIG. 1, then the jerky operation detection circuit 12 shown in FIG. 3 responds and issues a jerky-operation detection signal, or, more particularly in the special case described here, a flag RKFLG is set. This means that the jerky operation condition has been recognized. This procedure is continuously repeated, while the flag remains set for the processing in the region of a microprocessor until such time that the above-mentioned conditions no longer obtain. Herein, it is possible, by appropriately choosing the values of i and T, to unambigously select the frequency or frequencies that are characteristic for the jerky operation over a broad range of rotational speeds, while simultaneously preventing response of the anti-jerk control arrangement (AJC) of the present invention to other, especially deliberate, manipulations (for example, to a rhytmical operation of the power steering), or response to stochastic rotational speed oscillations of the motor or engine.

If the invention is implemented, in accordance with a currently preferred embodiment thereof, by the utilization of microprocessors or microcomputers, then the folowing procedure is followed, in particular, for the detection of the jerky operation, in that the jerky operation recognition algorithm is performed in each instance when a rotational speed change ΔN has been recognized:

1. After the detection of at least three successive positive ΔN increments, a flag * indicative of a rotational speed increase is set. Herein, these three successive ΔN increments must occur within a succession of at most seven ΔN icrements. If this condition is not satisifed, the jerky operation flag RKFLG is again reset and the end of the jerky operation control is commenced.

2. Thereafter, a negative ΔN must be detected or recognized after less than ten ΔN increments, which corresponds to a rotational speed which decreases again; otherwise, the jerky operation is recognized as being terminated and the RKFLG is reset. In response to the detection of the negative ΔN, a further flag ** is set and the rotational speed increase flag * is reset.

3. The previously recognized or detected rotational speed decrease must persist for at least three successive ΔN increments which must again occur within a succession of at most seven ΔN increments; if this happens, a last flag * is set and the previously set decrease-indication flag  is reset. After this point of the cyclical sequence has been reached, the jerky operation is confirmed as being recognized and the jerky operation flag RKFLG is set and the anti-jerk control function is activated thereby.

4. At this point, a positive ΔN increment must be recognized after the occurrence of less than ten ΔN increments; otherwise, the jerky operation is recognized as having terminated and the flag RKFLG is reset. This positive ΔN increment indicates the renewed increase in the rotational speed of the engine and is used for preventing the termination of the jerky operation recognition process.

5. The above-discussed operational steps are cyclically repeated.

Figure 2:
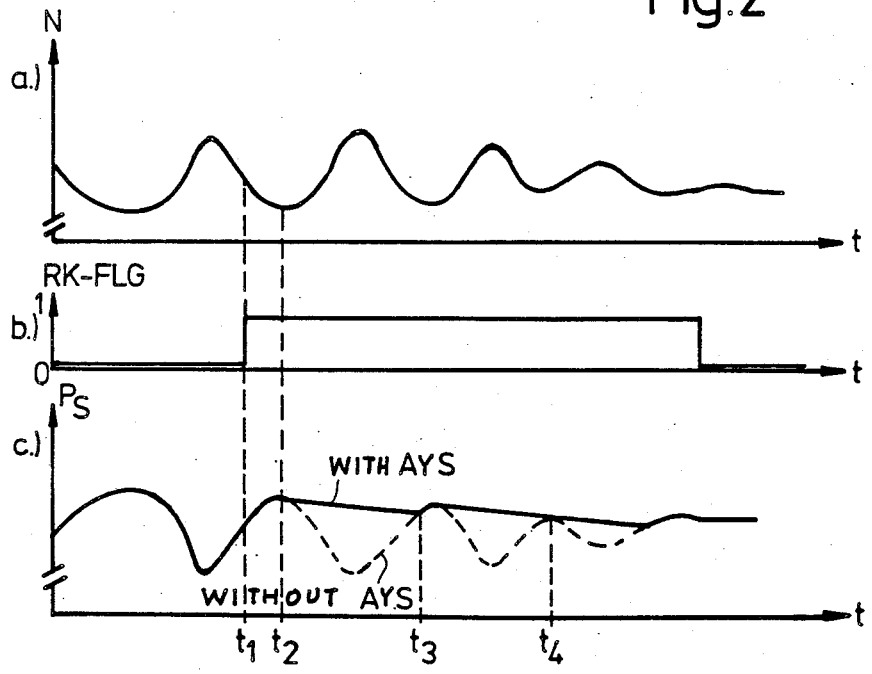
FIG. 2 is a graphic respresentation of three corellated variable behaviors as a function of time, namely, that of the rotational speed, that of a jerky-operation recognition signal, and that of the manipulated variable emanating from the proportional regulation region of the regulating device with and without the intervention of the anti-jerk control arrangement.

As soon as the jerky operation recognition signal is issued or the jerky operation flage RKFLG is set (compare the characteristic curve behavior b in FIG. 1 or the characteristic curve behavior b in FIG. 2), the proportional manipulated variable $P_S$ appearing at the output of the proportional region 10*a* of the idling operation regulation device 10 for the rotational speed regulation (N proportional negative feedback coupling) is no longer caused to follow the rotational speed behavior during the increase in the rotational speed, as it was before, but rather is caused to merely slowly change with a selectable time constant. In FIG. 2, there is indicated, at a, the characteristic behavior curve of the rotational speed N as a function of time t; at the time $t=t_1$, the jerky operation situation or tendency is recognized and the jerky operation flag RKFLG is set as shown at b in FIG. 2. From this time on, the behavior of the manipulated variable $P_S$ issued by the proportional region 10*a* of the regulation device 10 is changed in the manner indicated at c in FIG. 2, that is, when the rotational speed N still decreases, the manipulated variable $P_S$ continues to rise accordingly. However, after the manipulated variable $P_S$ has reached the upper turning point of the characteristic curve at the time $t=t_2$, it will no longer decrease in correspondence with the behavior curve indicated in dashed lines, as it would in the absence of the arrangement of the present invention (without AJC) inasmuch as during such normal behavior the rotational speed increases again commencing with the time point $t_2$ and thus the regulation deviation or error signal increases and, correspondigly, to counteract this deviation, the manipulated variable $P_S$ obtained from the proportional region 10*a* would have to decrease correspondingly); rather, the manipulated variable $P_S$ is, in accordance with the present invention, for all intents and purposes, held at the value reached at the time $t_2$, but preferably is caused to slowly decrease with a selectable time constant.

The normal manipulated variable behavior as obtained from the proportional negative feedback coupling without the AJC would thus be constituted by slowly diminishing oscillations according to the curve c of FIG. 2 (as shown in dashed lines), when it is assumed, for a still acceptable case, that no additioal enhancement of such oscillations would take place. In contradistinction thereto, the present invention fixes, commencing at the time of recognition of the jerky operation situation, this manipulated variable value at a level which is effective for causing the adjusting member for the air amount to open wider, and more particularly to such an extent as if the lowest acceptable actual rotational speed were constantly present during this AJC operation. Thus, there is obtained a combination effect which consists, on the one hand, in that the oscillatory behavior at the adjustment member, which otherwise results from the behavior of the proportional manipulated variable, is steadied, that is, damped in the manner which is illustrated in FIG. 2 at c (solid line behavior curve), that is, oscillations are not permitted any longer and, on the other hand, an increase in the rotational speed of the internal combustion engine is aimed at and achieved, so that the operation of the arrangement is moved out of the critical jerky operation rotational speed region. The intervention into the proportional regulation region by the anti-jerk control (AJC) of the present invention is assymetrical; thus, there is not generally damped or suppressed an amplitude of the oscillations; rather, what is achieved is an influencing of the proportional adjustment member manipulated variable behavior in a manner which can be likened to a peak value rectifying function, with the overall function being of such a character that the critical frequency region is so-to-say filtered out by resorting to the features and measures proposed by the present invention. There is obtained a particularly quick decay of the oscillations, without influencing the interception characteristics (during the rotational speed decrease) which are available in the respective idling operation filling regulation arrangement.

In addition to the above, it can be recognized from the characteristic behavior as depicted in FIG. 2 of the drawing that the behavior of the proportional manipulated variable with the AJC is implemented in such a manner, according to a currently preferred embodiment of the invention, that the selectable time constant results in gradual and rather slow decrease in the proportional manipulated variable so that, on the one hand, when another oscillatory movement occurs as shown at $t=t_3$, the manipulated variable is once more entrained for a short period of time for joint movement from the decreasing region of its behavior to a slightly higher value and, thereafter, again decreases in an inclined portion of its behavior curve, until it merges into the normal behavior (without AJC) after the resetting of the jerky operation flag. It can also be recognized that, under the influence of the anti-jerk control arrangement of the present invention, a further manipulated variable increase which is encountered at the time $t=t_4$ no longer reaches the gradually decreasing part of the behavior curve corresponding to the actually utilized and effective value of the manipulated variable. In this manner, the actual behavior of the manipulated variable as it appears at the output of the proportional negative feedback coupling arrangement in effect constitutes the envelope of the decaying manipulated variable behavior occurring when the regulating deviation or error signal is proportionally translated into the manipulated variable behavior (without AJC), after the tendency to conduct jerky motion is recognized in the arrangement of the present invention.

The block diagram of FIG. 3 constitutes a symbolic illustration of the above-discussed functional behavior. The jerky operation recognition device 12 includes, as indicated at 12*a*, a frequency and amplitude window having the effect which has been discussed above, so that a corresponding jerky operation recognition signal can be issued.

The proportional region 10*a* of the regulating device 10 is shown to be constructed as or to include an amplifier 15 and, in order to be able to indicate the asymmetrical intervention into the degree of amplification as it is realized in accordance with the invention, there is shown an adjustable resistor 15*a* with a diode 15*b*. Then, the effect of an adjustment region 12*b* on the amplification regulation of the proportional region 10*a* of the regulating device 10 when the present invention is being utilized is such that when the jerky operation recognition signal is made available, there is maintained the maximum amplification (corresponding to the maximum value of the manipulated variable from the proportional negative feedback coupling arrangement) and is permitted to decrease with a relatively long time constant, which is indicated in FIG. 3 of the drawing as a time-delay member constituted by a capacitor 16. This behavior of the decreasing part of the characteristic curve is overruled only when the regulating deviation or error signal as it is provided at the switching point 13, calls for an even greater degree of amplification than that which is represented by the gradually decreasing characteristic curve of the proportional manipulated variable at this time point.

It has already been referred to before that the present invention can also and preferably be implemented by using digital computation switching circuits, such as microprocessors or the like. In this case, there results a functional behavior for the anti-jerk control intervention as it was described above, especially in conjunction with the characteristic curve behaviors as depicted in FIGS. 1 and 2 of the drawing.

Figure 4:
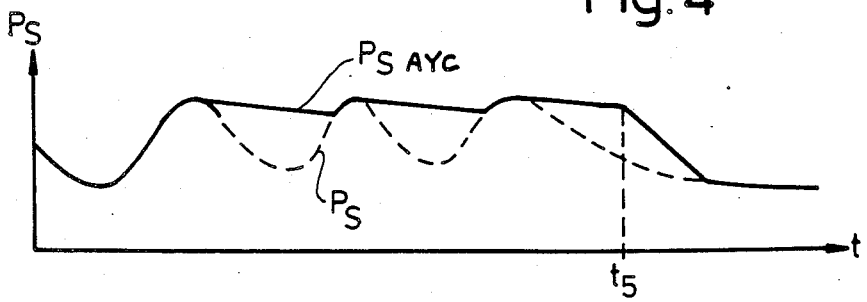
FIG. 4 is another graphic representation of the behavior of the manipulated variable as a function of time, particularly indicating the behavior after the termination of the anti-jerk control action.

Finally, the present invention proposes, in accordance with an advantageous feature thereof, that, after the resetting of the jerky operation flag RKFLG or after the discontinuance of the jerky operation recognition signal, the manipulated variable signal which is damped in the sense of a decaying peak value rectifier function upto this point, is thereafter caused to diminish at an increased speed, as can be ascertained from the characteristic curve behavior shown in FIG. 4 of the drawing commencing at the time $t=t_5$, this relatively rapid decrease continuing until the value of the original singal $P_S$ (without the AJC) is reached.

In the illustration of FIG. 3, the above-discussed expedient is indicated in such a manner that the time constant used for the decaying part of the characteristic behavior curve for the proportional amplifiaction is capable of being reduced in that, for instance, a further time-delay capacitor 18 is connected in parallel to the first-mentioned time-delay capacitor 16 by means of a switch 17.

The present invention enables a rapid and precise recognition of the tendency for jerky operation during the operation of the internal combustion engine in the idling operation region, by the arrangement of a frequency and amplitude window, and renders it possible, at a low cost and with the possibility of application to all systems of idling operation filling regulation, to achieve an effective oscillation-damping intervention into the operating characteristic, without encountering or causing any disadvantages in the regulating behavior of the respective idling operation filling regulation arrangement.

An alternative solution according to the present invention is obtained when, in contradistinction to what has been described above, it is not the output of the proportional regulator or region 10*a* for the rotational speed that is influenced, or this regulator or region 10*a* that is influenced as to its behavior, but rather the rotational speed difference or error signal as it appears behind or downstream of the comparison location or comparator 13 as it is supplied to the control input to the proportional regulator or region 10*a*. Inasmuch as the proportional regulator or regulating region 10*a*, correspondingly to its basic function, produces an output signal to the proportional adjustment member that causes adjustment contrary to the direction of the regulation deviation or error signal, it can thus be proceeded in such a manner that, after the recognition of the jerky operation behavior at the input of the regulating device 10 or of the regulating region 10*a*, the positive oscillation loops of the regulation deviation or error signal are suppressed, as a result of which the manipulated variable of the proportional regulator or regulating region 10*a* has the same characteristic behavior as indicated in solid lines at c in FIG. 2 (with AJC).

It will be understood that each of the elements described above, or two or more together, may also find a useful application in other types of arrangements differing from the type described above.

While the invention has been illustrated and described as embodied in an arrangement for regulating the idling operation rotational speed of an internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A method of regulating the idling rotational speed of an internal combustion engine using a regulating device having at least a proportional regulation region and operative for controlling the position of an adjustment element which controls the amount of intake air supplied to the engine during the idling operation of the latter, comprising the steps of comparing the actual and the desired rotational speeds and issuing an error signal indicative of the comparison result to the regulating device; detecting a jerky operation of the engine by evaluating the frequency and amplitude of rotational speed oscillations; and maintaining a manipulated variable of the proportional regulation region of the regulating device, in response to the detection of the jerky operation, asymmetrically only after an increase in the actual rotational speed, substantially at the respective highest achieved value thereof.

2. The method as defined in claim 1, and further comprising the step of causing the manipulated variable to gradually decrease with a selectable time constant, wherein the intervention into the amplification degree of the proportional regulation region of the regulating device is reminiscent of a peak value rectifier function.

3. The method as defined in claim 1, and further comprising the step of causing the manipulated variable after the decay of the rotational speed oscillations to diminish at a relatively high speed until it has reached its original characteristic behavior which it would have had in the absence of the detection of the jerky operation.

4. An arrangement for regulating the idling rotational speed of an internal combustion engine using a regulating device having at least a proportional regulation region and operative for controlling the position of an adjustment element which controls the amount of intake air supplied to the engine during the idling operation of the latter, comprising means for comparing the actual and the desired rotational speed of the engine and issuing an error signal indicative of the comparison result; means for supplying said error signal to the regulating device; means for detecting a jerky operation of the engine, including means for evaluating the frequency and amplitude of rotational speed oscillations; and means responsive to the detection of the jerky operation by said detecting means for so influencing the amplification degree of the proportional regulation region of the regulating device that at least a manipulated variable that determines the position of the adjustment element is maintained substantially at its maximum achieved value.

5. The arrangement as defined in claim 4; and further comprising time-delay means; and means for so connecting said time-delay means with one of said detecting means and the proportional regulation region of the regulating device that said manipulated variable is caused to gradually decrease with a selectable time constant after reaching said maximum achieved value thereof.

6. The arrangement as defined in claim 4; and further comprising means for causing the manipulated variable to diminis after the decay of the rotational speed oscillations at a relatively high speed until it has reached its original characteristic behavior which it would have had in the absence of the detection of the jerky operation by said detecting means.

* * * * *